US006741181B2

(12) United States Patent
Skaggs

(10) Patent No.: US 6,741,181 B2
(45) Date of Patent: May 25, 2004

(54) SYSTEM FOR TESTING A DUCT SMOKE OR OTHER HAZARDOUS GAS DETECTOR AND METHOD FOR USE THEREOF

(76) Inventor: Robert E. Skaggs, 1839 Argosy Ct., Bloomfield Hills, MI (US) 48302

( * ) Notice: Subject to any disclaimer, the term of this patent is extended or adjusted under 35 U.S.C. 154(b) by 0 days.

(21) Appl. No.: 09/859,987

(22) Filed: May 17, 2001

(65) Prior Publication Data

US 2002/0067276 A1 Jun. 6, 2002

Related U.S. Application Data

(60) Provisional application No. 60/204,847, filed on May 17, 2000.

(51) Int. Cl.[7] ..... G08B 17/10

(52) U.S. Cl. ..... 340/632; 340/628; 340/514; 340/693.5; 73/40.5 R

(58) Field of Search ..... 340/632, 628, 340/514, 693.5, 630; 73/40.5 R, 49.8

(56) References Cited

U.S. PATENT DOCUMENTS

| | | | | |
|---|---|---|---|---|
| 3,693,401 A | | 9/1972 | Purt et al. | 73/1 R |
| 3,881,112 A | | 4/1975 | Roberts | 250/565 |
| 4,271,693 A | | 6/1981 | Bute | 73/1 G |
| 4,301,674 A | | 11/1981 | Haines et al. | 73/1 G |
| 4,462,244 A | * | 7/1984 | Lee | 73/1 G |
| 5,361,623 A | | 11/1994 | Wantz | 73/1 G |
| 5,598,147 A | | 1/1997 | Mochizuki et al. | 340/630 |
| 5,670,946 A | * | 9/1997 | Ellwood et al. | 340/628 |
| 5,966,076 A | | 10/1999 | Cantrell | 340/605 |
| 6,640,608 B2 | * | 11/2003 | Pepper et al. | 73/1.02 |

FOREIGN PATENT DOCUMENTS

| | | |
|---|---|---|
| JP | 361082144 A | 4/1986 |
| JP | 05307690 A | 11/1993 |

* cited by examiner

*Primary Examiner*—Julie Lieu
(74) *Attorney, Agent, or Firm*—Gifford, Krass, Groh, Sprinkle, Anderson & Citkowski, P.C.

(57) ABSTRACT

A confined gas stream coupled hazardous gas detector enclosure includes a housing and a cover such that the housing and cover together define a housing volume adapted to enclose the detector. An aperture is present in either the housing or cover, and a port test valve is seated within the aperture. A nozzle matable to the port test valve is used to deliver a hazardous gas test mixture to the housing volume to elicit an active alarm signal from the detector without opening the cover.

21 Claims, 1 Drawing Sheet

SYSTEM FOR TESTING A DUCT SMOKE OR OTHER HAZARDOUS GAS DETECTOR AND METHOD FOR USE THEREOF

RELATED APPLICATION

This application claims priority of U.S. Provisional Patent Application No. 60/204,847 filed May 17, 2000 and is incorporated herein by reference.

FIELD OF THE INVENTION

The present invention relates to testing of a hazardous gas detector and more particularly, to testing of a hazardous gas detector in fluid communication with ductwork without removal of a cover enclosing the hazardous gas detector.

BACKGROUND OF THE INVENTION

The use of hazardous gas detectors is common within homes, offices and other buildings for the purpose of sounding an alarm upon the onset of a fire or other asphyxiation danger within the building. Hazardous gas detectors regardless of whether operating on ionization or optical absorption principles trigger an alarm upon sensing a threshold quantity of smoke particulate or hazardous gas so as to give people within the building early notification of the existence of a danger. While smoke detectors are frequently mounted in ceilings and other elevated regions within building rooms to take advantage of the fact that smoke rises to enhance the sensitivity of the smoke detector in residential buildings and other heavier than air hazardous gas detectors are situated proximal to combustion equipment, in commercial buildings and manufacturing facilities, hazardous gas detectors are most often coupled to air handling conduits. The air handling ducts of commercial or manufacturing facilities force air through a hazardous gas detector coupled to the air handling ductwork thereby reducing the number of hazardous gas detectors necessary to provide warning within a large structure and also to further enhance the sensitivity of the hazardous gas detector by actively forcing air therethrough.

Hazardous gas detectors coupled to forced air ductwork are encased within a cover enclosing the hazardous gas detector and often power leads thereto to lessen ductwork pressure drop across the hazardous gas detector. Since hazardous gas detectors function under operating conditions for extended periods of time without encountering threshold quantities of hazardous gas capable of triggering an alarm, it becomes necessary to test the operating condition of the hazardous gas detector at regular intervals. While the testing of a home smoke detector by bringing a fire source such as a lit match or candle or aerosol smoke into proximity with the smoke detector is a minor inconvenience, the testing of hazardous gas detectors coupled to ductwork becomes quite burdensome. In many cases, hazardous gas detectors coupled to ductwork are in inaccessible regions of a commercial or manufacturing facility. Further, testing of a ductwork coupled hazardous gas detector entails removal of the cover therefrom often through the removal of several fasteners. As a result, periodic testing of ductwork coupled hazardous gas detectors in a commercial or manufacturing facility can require several hours of hazardous work involving climbing a ladder or utilizing crawl spaces to access hazardous gas detector covers and often high-voltage power terminals. Thus, there exists a need for a duct coupled hazardous gas detector cover which is accessible for the testing of a hazardous gas detector enclosed therein without the necessity of removing the cover.

SUMMARY OF THE INVENTION

A confined gas stream coupled to a hazardous gas detector enclosure includes a housing and a cover such that the housing and cover together define a volume adapted to enclose a hazardous gas detector. An aperture extends through either the housing or the cover. A port test valve is adapted to seat within the aperture.

A system for testing a confined gas stream coupled hazardous gas detector includes a hazardous gas detector in fluid communication with an inlet duct and an outlet duct. A housing and a cover together define a housing volume adapted to enclose the detector. An aperture is located in at least one of the housing and the cover. A port test valve is adapted to seat within the aperture and is matable to a nozzle delivering a hazardous gas test mixture into the housing volume in sufficient quantity to elicit an active alarm signal from the gas detector. A process for testing a confined gas stream coupled hazardous gas detector includes sealing the detector within a volume and exposing the detector to the confined gas stream and thereafter introducing into the gas stream a quantity of hazardous gas test mixture through a port test valve to trigger an active alarm signal in the detector.

DETAILED DESCRIPTION OF THE PREFERRED EMBODIMENTS

The term "hazardous gas detector" as used herein is defined to include a device activated upon detection of a threshold quantity of a gaseous hazard including natural gas, carbon monoxide, smoke and a deficiency of oxygen.

Figure 1:
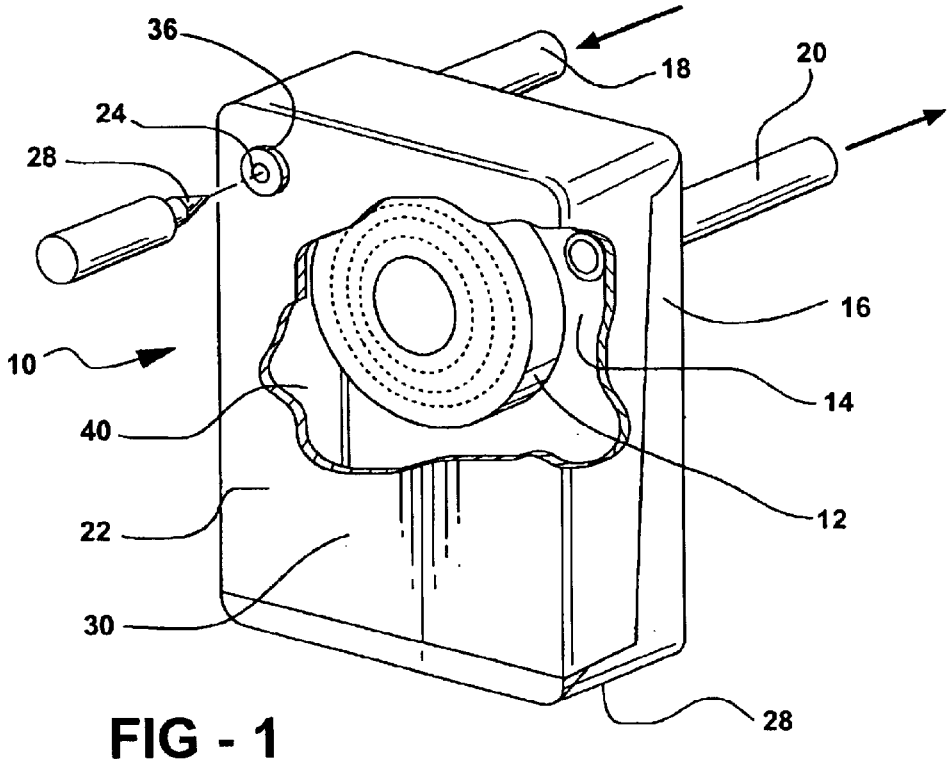
FIG. 1 is a perspective partial cut away view of a duct coupled hazardous gas detector testing system according to the present invention.

A system for detecting a confined gas stream coupled gaseous hazard detector is shown generally in FIG. 1 at 10. A hazardous gas detector 12 is affixed to an interior surface 14 of the detector housing 16. The detector housing 16 having an inlet 18 and an outlet 20, the inlet 18 and the outlet 20 in fluid communication with a gas stream to be sampled by hazardous gas detector 12. The detector housing 16 engages a cover 22 to form a substantially closed interior volume only in fluid communication through the inlet 18 and outlet 20. Optionally, a gasket or sealant is utilized to improve the integrity between the cover 22 and the housing 16. A port test valve 24 is secured within an aperture 26. While in the embodiment depicted in FIG. 1, the port test valve 24 is secured within the cover 22, it is appreciated that a port test valve is readily secured through the housing 16 or the inlet 18. Preferably, a port test valve is located on a cover or housing in an orientation facilitating easy access. For example, a port test valve is secured in the bottom surface 28 of the housing 16 when the housing is most readily accessed from below or a port test valve is positioned in the front face 30 of the cover 32 in instances where access is most easily obtained thereto.

A housing according to the present invention is constructed from materials illustratively including steel, aluminum, fiberglass, galvanized steel, anodized aluminum and painted forms thereof. Likewise, a cover according to the present invention is illustratively constructed from steel, aluminum, fiberglass, galvanized steel, anodized aluminum and painted forms thereof. Preferably, a cover according to the present invention is constructed of a transparent thermoplastic material or as a transparent glass or thermoplastic window therein to provide for a visual inspection of a hazardous gas detector enclosed therein.

A port test valve according to the present invention is formed from an elastomeric material capable of being penetrated by a matable nozzle. In a preferred embodiment of the present invention, nozzle 28 is a needle adapted to penetrate the port test valve 24. It is appreciated that in lieu of an elastomeric test valve, a port test valve according to the present invention can illustratively include a stop cock, screw valve or needle valve fitting produced from conventional materials. Thus, the operation system 10 operates through the insertion of nozzle 28 to port test valve 24 the nozzle 28 connected to a supply of pressurized hazardous gas mixture. Preferably, the pressurized gas mixture is prepackaged in an aerosol can. It is appreciated that other containers operative herein include a gas cylinder, or in the case of liquid smoke, a squirt bottle, optionally connected to the nozzle 28. Upon insertion of the nozzle 28 through the port test valve 24, the hazardous gas test mixture is released into the housing volume 40. Owing to the gas flow associated with the gas stream passing through inlet 18 through the housing volume 40 and out through outlet 20, the hazardous gas test mixture comes into contact with the hazardous gas detector 12 thereby triggering an active alarm signal. After the hazardous gas test mixture has been purged from the housing volume 40 through the continuous gas stream movement, the active alarm signal associated with the hazardous gas detector 12 is deactivated.

Figure 2:
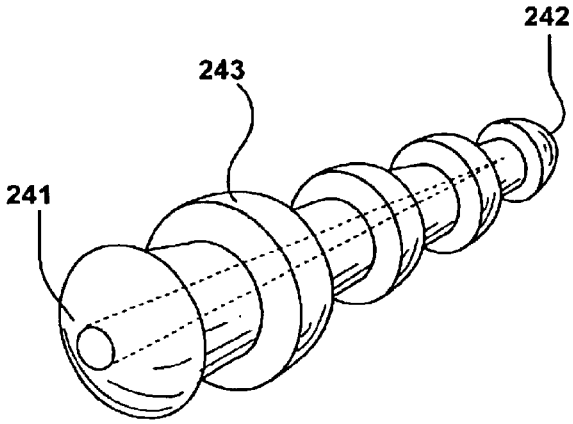
FIG. 2 is a perspective view of a test port valve seated within a cover according to the present invention.
Figure 3:
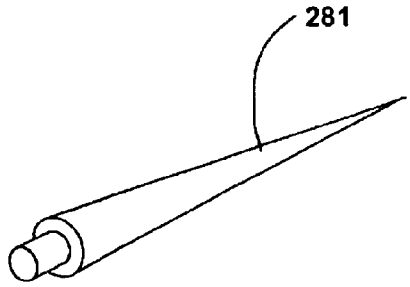
FIG. 3 is a perspective view of a matable nozzle to the test port valve depicted in FIG. 2.

Port test valve 24 as depicted in FIGS. 1 and 2 is amenable to retrofitting. The embodiment of the valve shown in FIG. 2 has a blind hole therein extending from the exterior face 241 and terminating before reaching the interior face of 242. At least one rib 243 is provided along the length of the port test valve 24 such that the aperture 26 in the cover 22 is engaged between the exterior face 241 and the rib 243 to hold the port test valve in place. A matable nozzle connected to a hazardous gas test mixture is inserted through the exterior face 241 and is able to release the hazardous gas test mixture through the nozzle tip 281 upon penetrating the interior face 242.

The foregoing description is illustrative of particular embodiments of the present invention, but is not meant to be a limitation upon the practice thereof. Changes and other uses for the present invention will occur to those skilled in the art with those changes being within the scope of the invention as defined by the appended claims. The following claims, including all equivalents thereof, are intended to define the scope of the invention.

What is claimed is:

1. A confined gas stream coupled hazardous gas detector enclosure comprising:

a housing;

a cover wherein said housing and said cover together define a housing volume adapted to enclose a hazardous gas detector only in fluid communication with a confined gas stream sampled during operating conditions for a non-test hazardous gas wherein at least one of said housing and said cover has an aperture therethrough; and a port test valve adapted to seat within the aperture, such that said valve is activated concurrently with sampling the gas stream.

2. The enclosure of claim 1 wherein the housing volume is adapted to enclose a smoke detector.

3. The enclosure of claim 1 wherein the housing volume is adapted to enclose a deficiency of oxygen detector.

4. The enclosure of claim 1 wherein the housing volume is adapted to enclose a carbon monoxide detector.

5. The enclosure of claim 1 further comprising a gasket intermediate between said housing and said cover.

6. The enclosure of claim 1 further comprising a sealant intermediate between said housing and said cover.

7. The enclosure of claim 1 wherein said housing further comprises an inlet and an outlet.

8. The enclosure of claim 1 wherein said valve is secured to said housing.

9. The enclosure of claim 7 wherein said valve is secured to said inlet.

10. The enclosure of claim 1 wherein said valve is formed of an elastomeric material.

11. The enclosure of claim 1 wherein said valve comprises a fitting selected from the group consisting of: stop cock, screw valve and needle valve fittings.

12. The enclosure of claim 10 wherein said valve has an external face and a rib adapted to seat the aperture between the external face and the rib.

13. A system for testing a confined gas stream coupled hazardous gas detector comprising:

a hazardous gas detector;

an inlet duct and an outlet duct in fluid communication with said hazardous gas detector;

a housing;

a cover together with said housing defining a housing volume adapted to enclose said hazardous gas detector sampling continuously the confined gas stream wherein at least one of said housing and said cover has an aperture therein;

a port test valve adapted to seat within the aperture; and a nozzle matable to said test valve delivering a hazardous gas test mixture into the housing volume in sufficient quantity to elicit an active alarm signal from said hazardous gas detector while concurrently sampling the confined gas stream.

14. The enclosure of claim 13 further comprising a gasket intermediate between said housing and said cover.

15. The enclosure of claim 13 further comprising a sealant intermediate between said housing and said cover.

16. The system of claim 13 wherein said nozzle comprises a needle.

17. The system of claim 13 wherein said nozzle is coupled to a container for the hazardous gas test mixture.

18. A process for testing a confined gas stream coupled hazardous gas detector comprising the steps of:

sealing a hazardous gas detector within a volume such that said detector is only in fluid communication with the confined gas stream;

exposing said hazardous gas detector to the confined gas stream to be continuously sampled; and introducing into the gas stream a quantity of hazardous gas test mixture through a port test valve to trigger an active alarm signal in said hazardous gas detector concurrent with sampling the confined gas stream.

19. The process of claim 18 wherein introduction of the hazardous gas test mixture comprises expelling the mixture from a container connected to a nozzle engaging said valve.

20. A confined gas stream coupled hazardous gas detector enclosure comprising:

a housing;

a transparent cover wherein said housing and said cover together define a housing volume adapted to enclose a hazardous gas detector only in fluid communication with a confined gas stream therein wherein at least one of said housing and said cover has an aperture therethrough; and a port test valve adapted to seat within the aperture, such that said valve is activated concurrently with sampling the gas stream.

21. A system for testing a confined gas stream coupled hazardous gas detector comprising:

a hazardous gas detector;

an inlet duct and an outlet duct in fluid communication with said hazardous gas detector;

a housing;

a transparent cover together with said housing defining a housing volume adapted to enclose said hazardous gas detector therein wherein at least one of said housing and said cover has an aperture therein;

a port test valve adapted to seat within the aperture; and a nozzle matable to said test valve delivering a hazardous gas test mixture into the housing volume in sufficient quantity to elicit an active alarm signal from said hazardous gas detector while concurrently sampling the confined gas stream.

* * * * *